US006712080B1

(12) United States Patent
Handschuh et al.

(10) Patent No.: US 6,712,080 B1
(45) Date of Patent: Mar. 30, 2004

(54) FLUSHING SYSTEM FOR REMOVING LUBRICANT COKING IN GAS TURBINE BEARINGS

(75) Inventors: Robert F. Handschuh, North Olmsted, OH (US); Gary L. Farley, Yorktown, OH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 114 days.

(21) Appl. No.: 10/075,282

(22) Filed: Feb. 15, 2002

(51) Int. Cl.[7] ..... B08B 3/08

(52) U.S. Cl. ..... 134/95.1; 134/99.1; 134/103.1; 134/105

(58) Field of Search ..... 134/94.1, 95.1, 134/97.1, 99.1, 99.2, 103.1, 105, 111, 166 R, 116, 169 R, 169 A, 113

(56) References Cited

U.S. PATENT DOCUMENTS 3,074,822 A * 1/1963 Walk et al.
3,486,582 A * 12/1969 Carter et al.
4,046,155 A * 9/1977 Mansson
4,059,123 A * 11/1977 Bartos et al.
4,065,322 A * 12/1977 Langford
4,196,020 A * 4/1980 Hornak et al.
4,309,870 A * 1/1982 Guest et al.
4,377,420 A * 3/1983 Granatek et al.
4,424,665 A * 1/1984 Guets et al.
4,698,130 A * 10/1987 Restall et al.
4,891,934 A * 1/1990 Huelster
5,273,395 A * 12/1993 McDermott
5,868,860 A * 2/1999 Asplund
5,938,402 A * 8/1999 Bochud et al.
5,944,483 A * 8/1999 Beck et al.
6,073,637 A * 6/2000 Hayward et al.
6,310,022 B1 * 10/2001 Amiran
6,475,290 B2 * 11/2002 Jones
6,503,334 B2 * 1/2003 Ruiz et al.

FOREIGN PATENT DOCUMENTS

WO WO 92/14557 * 9/1992

* cited by examiner

*Primary Examiner*—Frankie L. Stinson
(74) *Attorney, Agent, or Firm*—William Randolph

(57) ABSTRACT

A flushing system for flushing away any coking material which may have built up in the bearing of a gas turbine. Three fluid tanks respectively contain a solvent for dissolving the coked material, a cleaner and a lubricant. By means of a three-way valve, one of the fluids is provided to a supply pump for delivery to the bearing housing via a quick disconnect coupling. Fluid is returned to the appropriate tank by means of a return pump, via a quick disconnect coupling and another three-way valve between the return pump and the tanks. The system includes respective filters for filtering the return fluids and the entire system may be carried on a wheeled cart for servicing the gas turbine.

11 Claims, 2 Drawing Sheets

FLUSHING SYSTEM FOR REMOVING LUBRICANT COKING IN GAS TURBINE BEARINGS

STATEMENT OF GOVERNMENT INTEREST

The invention described herein may be manufactured and used by or for the Government of the United States of America for government purposes without the payment of any royalties therefor.

BACKGROUND OF THE INVENTION

Gas turbines, including those used for propelling military vehicles, include two or more opposed bearings which must be continuously lubricated during gas turbine usage. This is accomplished by means of a lubricating system which provides the bearings with a lubricating fluid, such as natural or synthetic oil, to not only lubricate the bearings but to also provide for cooling.

When the gas turbine is shut down after usage, the residual heat from the turbine (which may be hundreds of degrees Fahrenheit) soaks back to the bearings leading to a possible coking condition. This is even more pronounced if there is insufficient engine idle time before turbine shut down. Basically, coking is the result of the lubricant becoming an oxidized solid oil deposit on the bearing surface and in the lubricant delivery system that can lead to insufficient lubricant supply to the bearings. This can result in engine seizure and/or a requirement for a complete engine overhaul, which is undesirable, particularly in tactical combat situations.

Accordingly, it is a primary object of the present invention to provide apparatus which flushes away the coked lubricant in rotating machinery bearings, particularly, in gas turbines which shut down at high temperatures.

SUMMARY OF THE INVENTION

A flushing system for removing lubricant coking in a turbine bearing, within a bearing housing having a fluid inlet and fluid outlet, includes a plurality of fluid containing tanks, at least a first of which contains a coking solvent, a second of which contains a cleaner and a third of which contains a lubricant. First and second couplings are provided with a first coupling being connected to the fluid inlet and the second coupling being connected to the fluid outlet, of the bearing housing. A supply pump has an outlet connected to the first coupling, and a return pump has an inlet connected to the second coupling. A first valving arrangement is connected between the tanks, and an inlet of the supply pump, and is operable to provide fluid from a selected one of the tanks to the supply pump for delivery to the bearing housing. A second valving arrangement is connected between an outlet of the return pump and the tanks, to supply return fluid from the bearing housing to the particular tank selected by the first valving arrangement.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
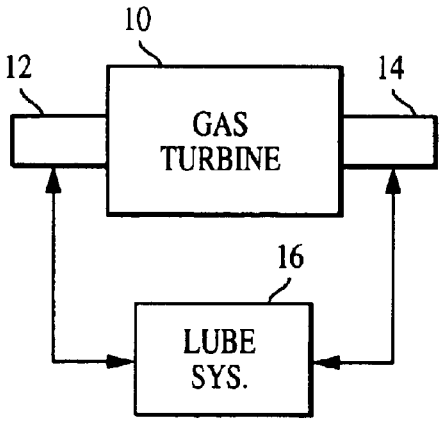
FIG. 1 is a simplified block diagram of a gas turbine and lubricating system.

In the drawings, which are not necessarily to scale, like or corresponding parts are denoted by like or corresponding reference numerals.

In FIG. 1, a rotating gas turbine 10 is supported by opposed first and second bearings 12 and 14, although, more such bearings may be utilized, depending upon turbine size and design.

A lubricating system 16 is provided in order to supply the bearings with necessary lubrication and cooling during use, and when the gas turbine 10 shuts down, the lubrication system 16 also shuts down, leading to a possible coking condition, as previously explained. The present invention obviates this problem by flushing away any coked deposits, and to this end, reference is made to FIG. 2.

Figure 2:
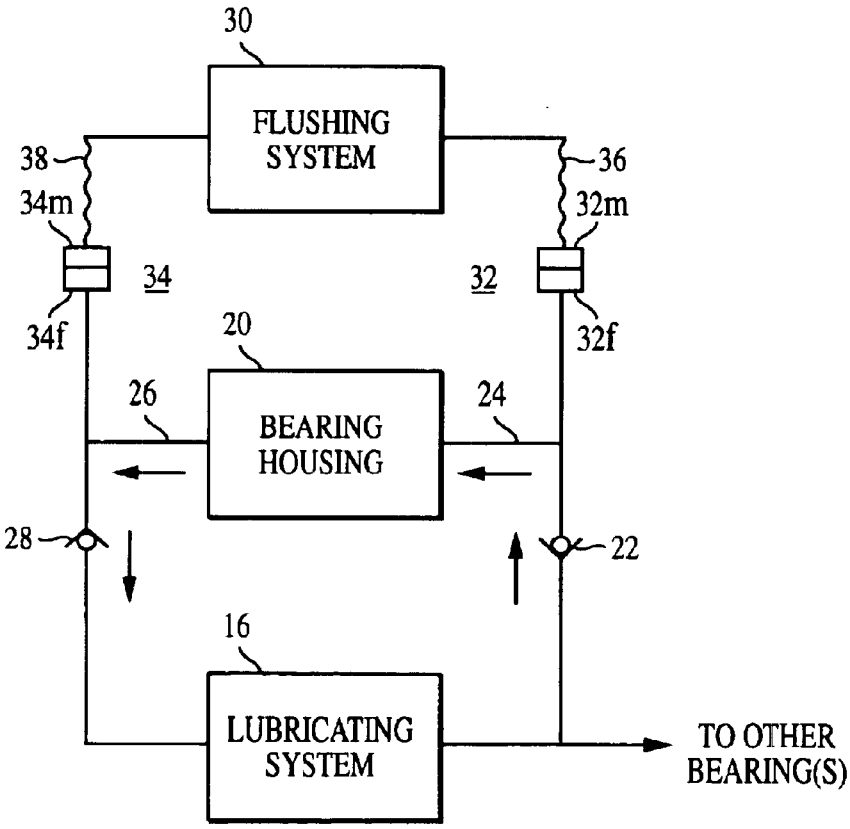
FIG. 2 is a block diagram of the flushing system of the present invention, attached to a bearing as in FIG. 1.

In FIG. 2, the lubricating system 16 is illustrated as being connected to a representative bearing housing 20 for delivering lubricating fluid to the bearing, via a one-way valve 22 and fluid inlet 24, and for receiving used lubricant from the bearing, via fluid outlet 26 and one-way valve 28. Flushing system 30 is connectable with the bearing housing inlet 24 by means of coupling 32 and is connectable with the bearing housing outlet 26 by means of coupling 34.

The flushing system 30 may be a permanent installation in a maintenance facility, or, may be a portable system in which a system carrier is wheeled up to the gas turbine-driven vehicle. To facilitate rapid servicing, the couplings 32 and 34 are preferably of the threadless quick-disconnect type which have respective male connectors 32*m* and 34*m*, which mate with respective female connectors 32*f* and 34*f*. When uncoupled, the female connectors 32*f* and 34*f* prevent fluid from exiting the connector. The portable system also includes respective flexible hoses 36 and 38, which may be wound up upon the carrier.

Figure 3:
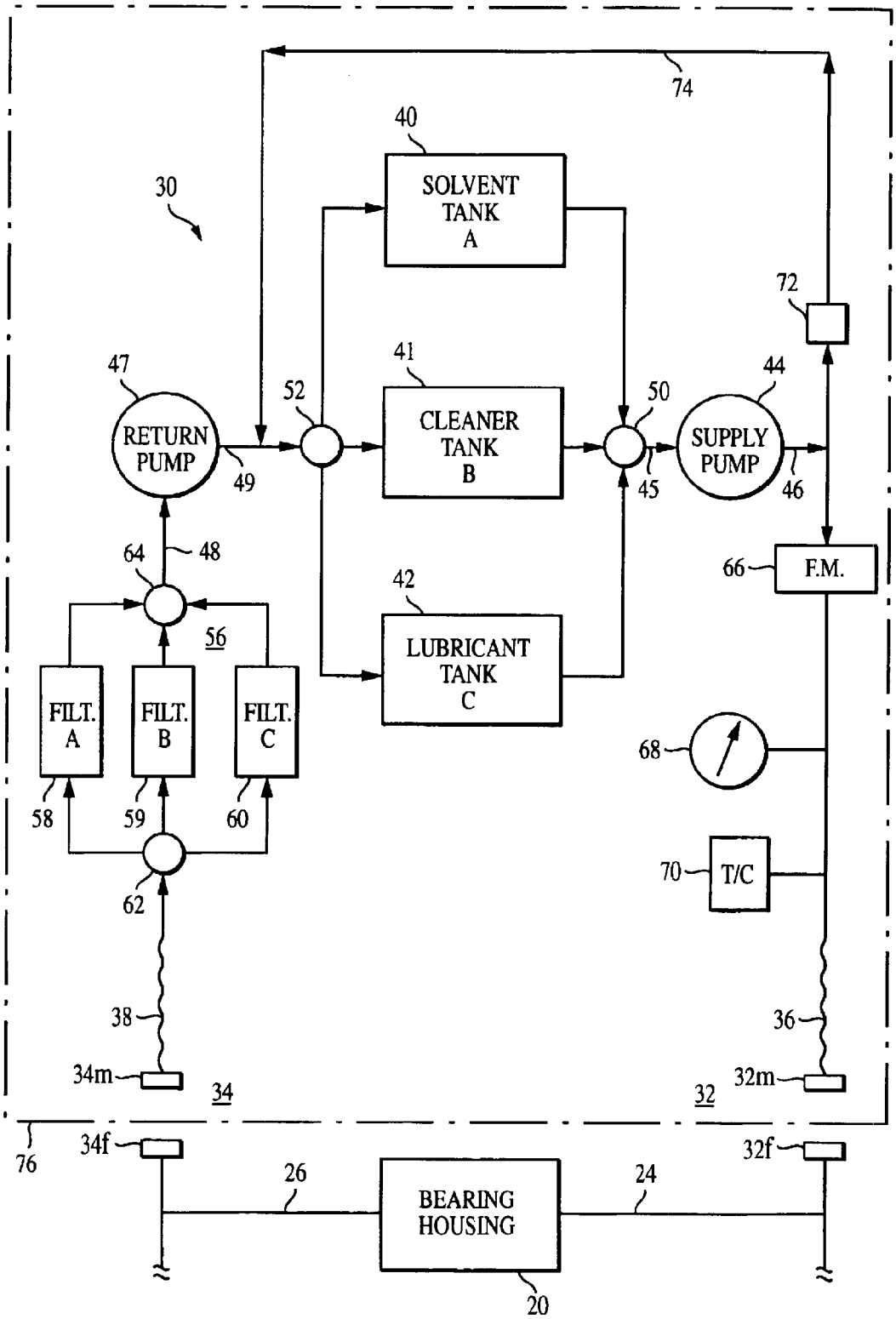
FIG. 3 is a more detailed presentation of the flushing system of FIG. 2.

A more detailed view of the flushing system 30 is presented in FIG. 3. After the gas turbine on the vehicle has shut down, the flushing system 30 is wheeled up to the vehicle and is connected to the bearing inlet 24 and outlet 26 by unwinding the flexible hoses 36 and 38 and by bringing together the respective connectors of couplings 32 and 34.

The flushing system 30 includes a plurality of fluid holding tanks 40–42, a first of which contains a solvent for dissolving any coked oil. By way of example the solvent may be a 50-50 solution of tetrahydrofuran and cyclohexane which turns the coked lubricant into a fine powder. A second tank, 41, contains a cleaner, such as alcohol or kerosene, to remove any solvent and dissolved coke material. A third tank, 42, contains lubricant to re-lubricate the bearings.

By a valving arrangement, the liquids in the tanks 40–42 are selectively provided to the bearing housing 20 via coupling 32, by means of a supply pump 44, having an inlet 45 and outlet 46, and liquid is withdrawn from the bearing housing 20 by means of a scavenge, or return pump, 47, having an inlet 48 and outlet 49. More particularly, the valving arrangement includes a first three-way valve 50 which is automatically, or hand operated, to selectively connect supply pump 44 with either solvent tank 40, cleaner tank 41 or lubricant tank 42. A similar three-way valve 52 is operative to selectively direct return fluid from return pump 47, to either solvent tank 40, cleaner tank 41 or lubricant tank 42.

Prior to entering the return pump 47, return fluid from the bearing is preferably filtered. This is accomplished with the provision of a filter station 56 comprised of three filters 58–60, one for each of the tanks 40–42, and selectively put into the fluid circuit by means of three-way valves 62 and 64. These valves 62 and 64 are operated to direct fluid: A) to filter 58 when solvent from solvent tank 40 is being supplied, B) to filter 59 when cleaner from cleaner tank 41 is being supplied, and C) to filter 60 when lubricant from lubricant tank 42 is being supplied.

In operation, after coupling with the bearing housing 20, the pumps 44 and 47 of the flushing system 30 are turned on such that, initially, solvent from tank 40 is provided to the bearing with the proper positioning of three-way valves 50, 52, 62 and 64. The solvent is continuously supplied to the bearing for a period of time in order to dissolve the coked material. In order to assist in determining this period of time, a flowmeter 66 is provided in the fluid line from supply pump 44 to the bearing housing 20. Based upon an increased flow rate of the solvent, as determined by the flowmeter 66, the valving arrangement may be changed so as to next provide cleaner from tank 41 to remove the solvent from the bearing housing 20. After another predetermined period of time, the three-way valves are positioned to supply lubricant from tank 42 for a few minutes, to replenish the bearing housing 20 with fresh lubricant prior to a subsequent start-up of the gas turbine.

In order to further monitor the system during the flushing operation, the system also includes a pressure gage 68 and a thermocouple 70, both of which are connected to the fluid circuit downstream of the supply pump 44. Additionally, if the pressure in the fluid line exceeds a certain value, a relief valve 72 is operative to direct the fluid from pump 44 back to three-way valve 52 via fluid line 74. After the complete flushing operation, couplings 32 and 34 are disconnected and the gas turbine-driven vehicle may return to its assigned task.

As mentioned, the flushing system 30 may be completely portable for delivering the system to a gas turbine-driven vehicle for servicing. Accordingly, the components of the flushing system 30 may be carried on a wheeled cart, generally represented by the numeral 76, in FIG. 3.

It will be readily seen by one of ordinary skill in the art that the present invention fulfills the primary object set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A flushing system for removing lubricant coking in a turbine bearing, within a bearing housing having a fluid inlet and fluid outlet, comprising:

a plurality of fluid containing tanks, at least a first of which contains a coking solvent, a second of which contains a cleaner and a third of which contains a lubricant;

first and second couplings, said first coupling being connected to said fluid inlet and said second coupling being connected to said fluid outlet, of said bearing housing;

a supply pump having an inlet, and having an outlet connected to said first coupling;

a return pump having an outlet, and having an inlet connected to said second coupling;

a first valving arrangement connected between said plurality of tanks and said inlet of said supply pump and operable to provide fluid from a selected one of said tanks to said supply pump for delivery to said bearing housing;

a second valving arrangement connected between said outlet of said return pump and said tanks to supply return fluid from said bearing housing to said tank selected by said first valving arrangement.

2. A system according to claim 1 wherein:

said first valving arrangement is a three-way valve.

3. A system according to claim 1 wherein:

said second valving arrangement is a three-way valve.

4. A system according to claim 1 wherein:

said first and second couplings are threadless quick-disconnect couplings.

5. A system according to claim 1 which includes:

at least three fluid filters each for filtering a respective one of said fluids returning to said tank selected by said first valving arrangement.

6. A system according to claim 5 wherein:

said filters are positioned in the fluid line between said second coupling and said inlet of said return pump; and which includes third and fourth valving arrangements for placing a selected one of said filters into the fluid circuit.

7. A system according to claim 1 which includes:

a flowmeter in the fluid circuit between said outlet of said supply pump and said first coupling.

8. A system according to claim 1 which includes:

pressure and temperature sensors positioned for obtaining pressure and temperature readings of the fluid in the fluid circuit between said outlet of said supply pump and said first coupling.

9. A system according to claim 1 which includes:

a fluid line connecting said outlet of said supply pump to said outlet of said return pump; and a relief valved positioned in said fluid line.

10. A system according to claim 1 wherein:

said flushing system is carried on a wheeled cart.

11. A system according to claim 1 wherein:

said turbine bearing is a gas turbine bearing.

* * * * *